US009711912B2

(12) United States Patent
Xing et al.

(10) Patent No.: US 9,711,912 B2
(45) Date of Patent: Jul. 18, 2017

(54) CABLE CONNECTOR ASSEMBLY WITH IMPROVED INSULATIVE MEMBER

(71) Applicant: FOXCONN INTERCONNECT TECHNOLOGY LIMITED, Grand Cayman (KY)

(72) Inventors: Da-Wei Xing, Kunshan (CN); Jia-Chao Yan, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/209,784

(22) Filed: Jul. 14, 2016

(65) Prior Publication Data

US 2017/0018882 A1 Jan. 19, 2017

(30) Foreign Application Priority Data

Jul. 14, 2015 (CN) ..... 2015 1 0409801

(51) Int. Cl.

| | |
|---|---|
| ***H01R 13/648*** | (2006.01) |
| ***H01R 13/659*** | (2011.01) |
| ***H01R 13/50*** | (2006.01) |
| ***H01R 24/62*** | (2011.01) |
| *H01R 107/00* | (2006.01) |

(52) U.S. Cl.

CPC ..... *H01R 13/659* (2013.01); *H01R 13/50* (2013.01); *H01R 24/62* (2013.01); *H01R 2107/00* (2013.01)

(58) Field of Classification Search

CPC ..... H01R 13/659; H01R 24/62; H01R 13/50; H01R 2107/00

USPC ..... 439/607.25

See application file for complete search history.

(56) References Cited

U.S. PATENT DOCUMENTS

| | | | | |
|---|---|---|---|---|
| 7,559,805 | B1 | 7/2009 | Yi et al. | |
| 8,708,753 | B2 * | 4/2014 | Wang | H01R 13/6658 439/660 |
| 2014/0349523 | A1 | 11/2014 | Peng et al. | |

* cited by examiner

*Primary Examiner* — Javaid Nasri

(74) *Attorney, Agent, or Firm* — Wei Te Chung; Ming Chieh Chang

(57) ABSTRACT

A cable connector assembly includes an insulative housing, a number of contacts retained in the insulative housing, a printed circuit board electrically connected with at least some of the contacts, a cable electrically connected with the contacts and the printed circuit board, an insulative member enclosing the printed circuit board, and a shielding case enclosing the insulative housing and the insulative member, wherein the insulative member includes a recess portion spaced from the shielding case.

19 Claims, 9 Drawing Sheets

CABLE CONNECTOR ASSEMBLY WITH IMPROVED INSULATIVE MEMBER

BACKGROUND OF THE INVENTION

1. Field of the Invention

The present invention relates to a cable connector assembly, and more particularly to a cable connector assembly having improved insulative member.

2. Description of Related Art

U.S. Pat. No. 7,559,805, issued on Jul. 14, 2009, discloses a plug connector including an internal printed circuit board interconnected between a plurality of contacts and a plurality of cable wires.

BRIEF SUMMARY OF THE INVENTION

According to one aspect of the present invention, a cable connector assembly comprises: an insulative housing; a plurality of contacts retained in the insulative housing; a printed circuit board electrically connected with at least some of the plurality of contacts; a cable electrically connected with the contacts and the printed circuit board; an insulative member enclosing the printed circuit board; and a shielding case enclosing the insulative housing and the insulative member; wherein the insulative member includes a recess portion spaced from the shielding case.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
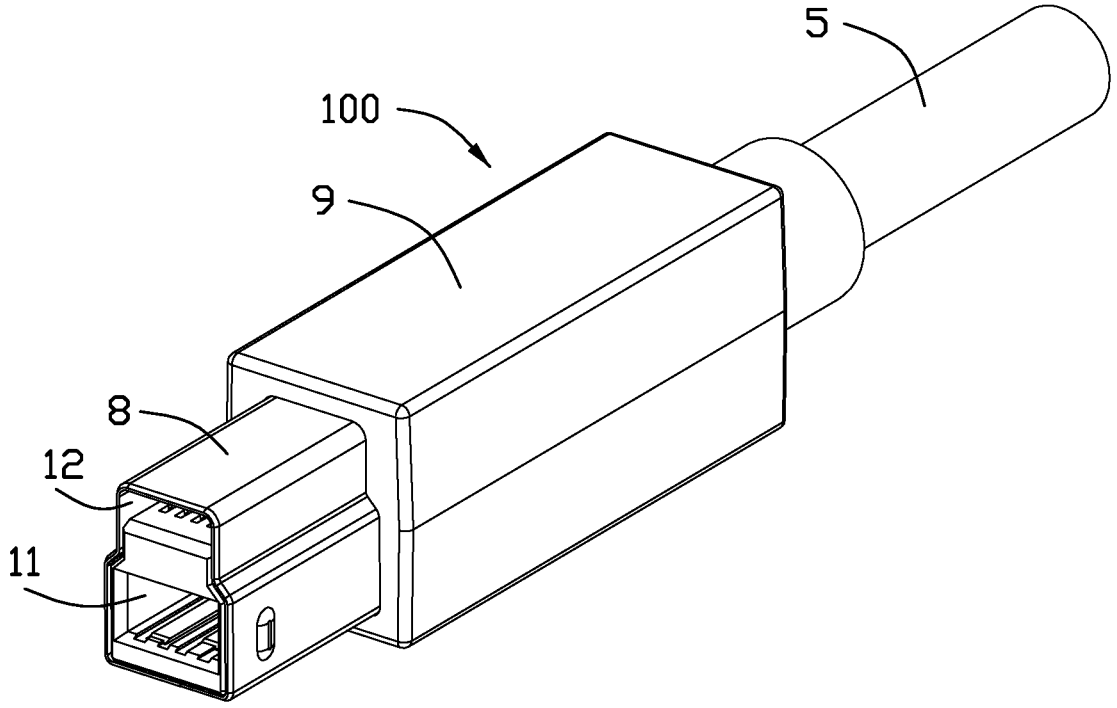
FIG. 1 is a perspective assembled view of a cable connector assembly according to the present invention.
Figure 2:
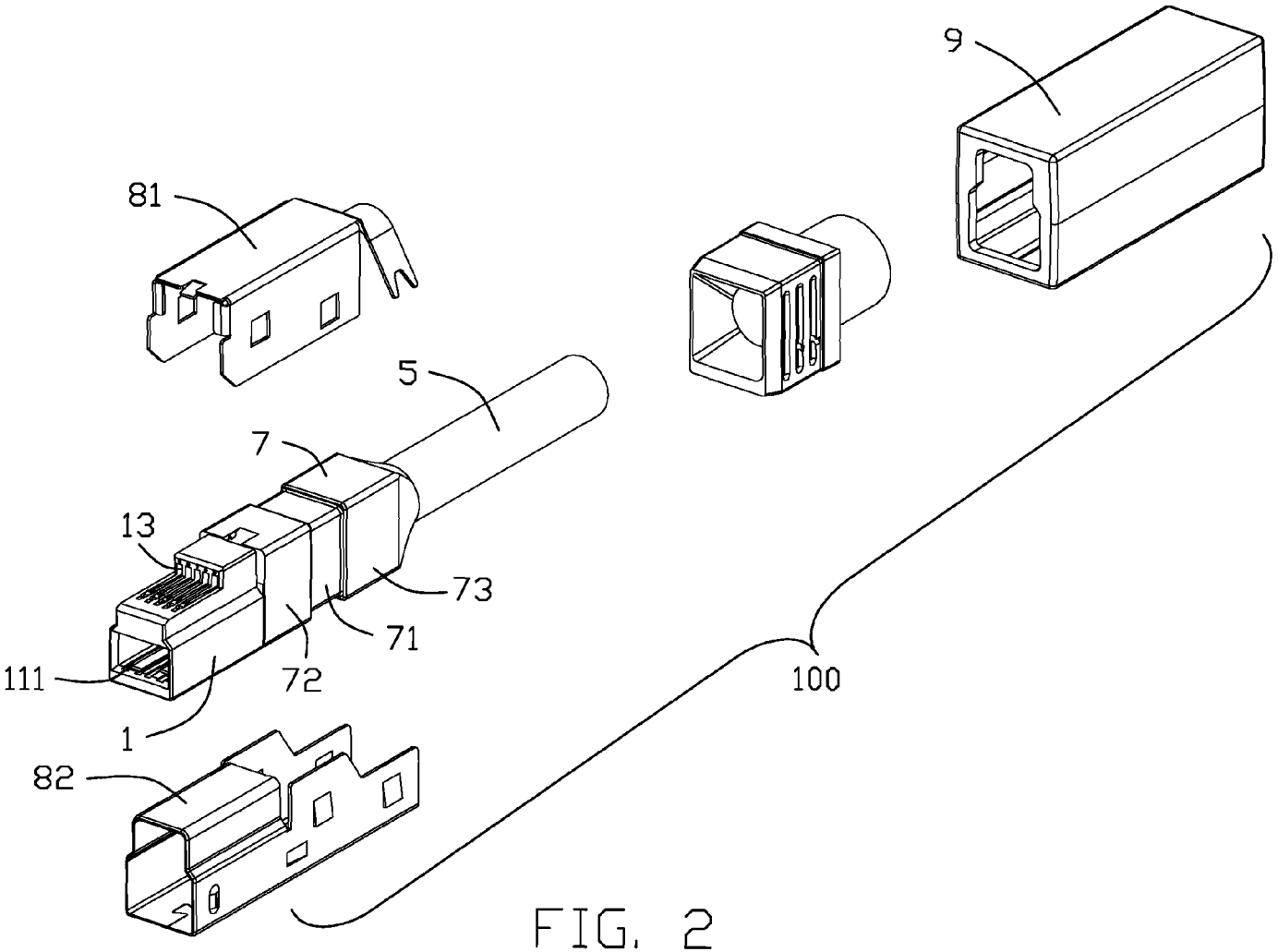
FIG. 2 is a partly exploded view of the cable connector assembly shown in FIG. 1.
Figure 3:
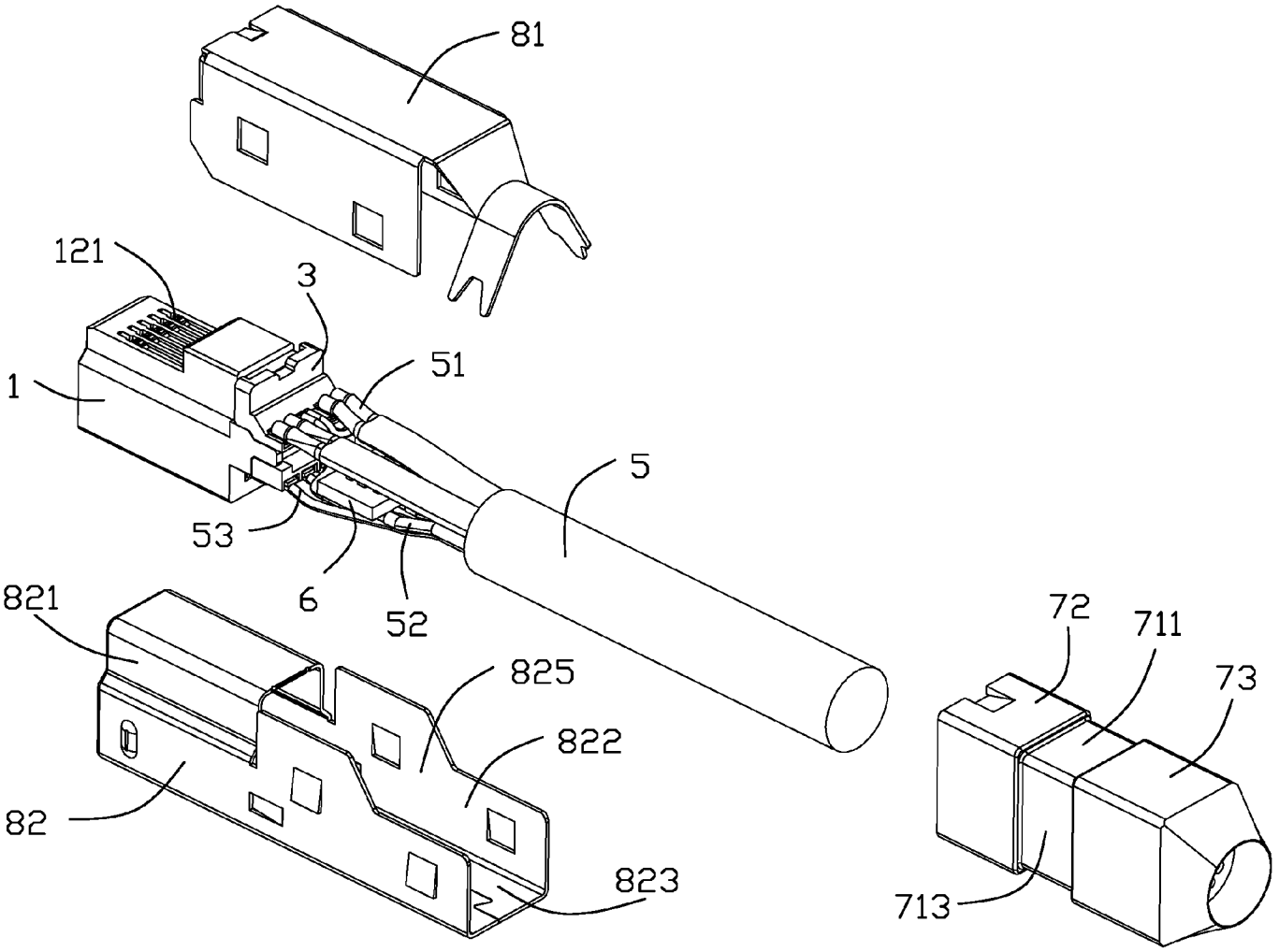
FIG. 3 is a partly exploded view of a part of the cable connector assembly shown in FIG. 1.
Figure 4:
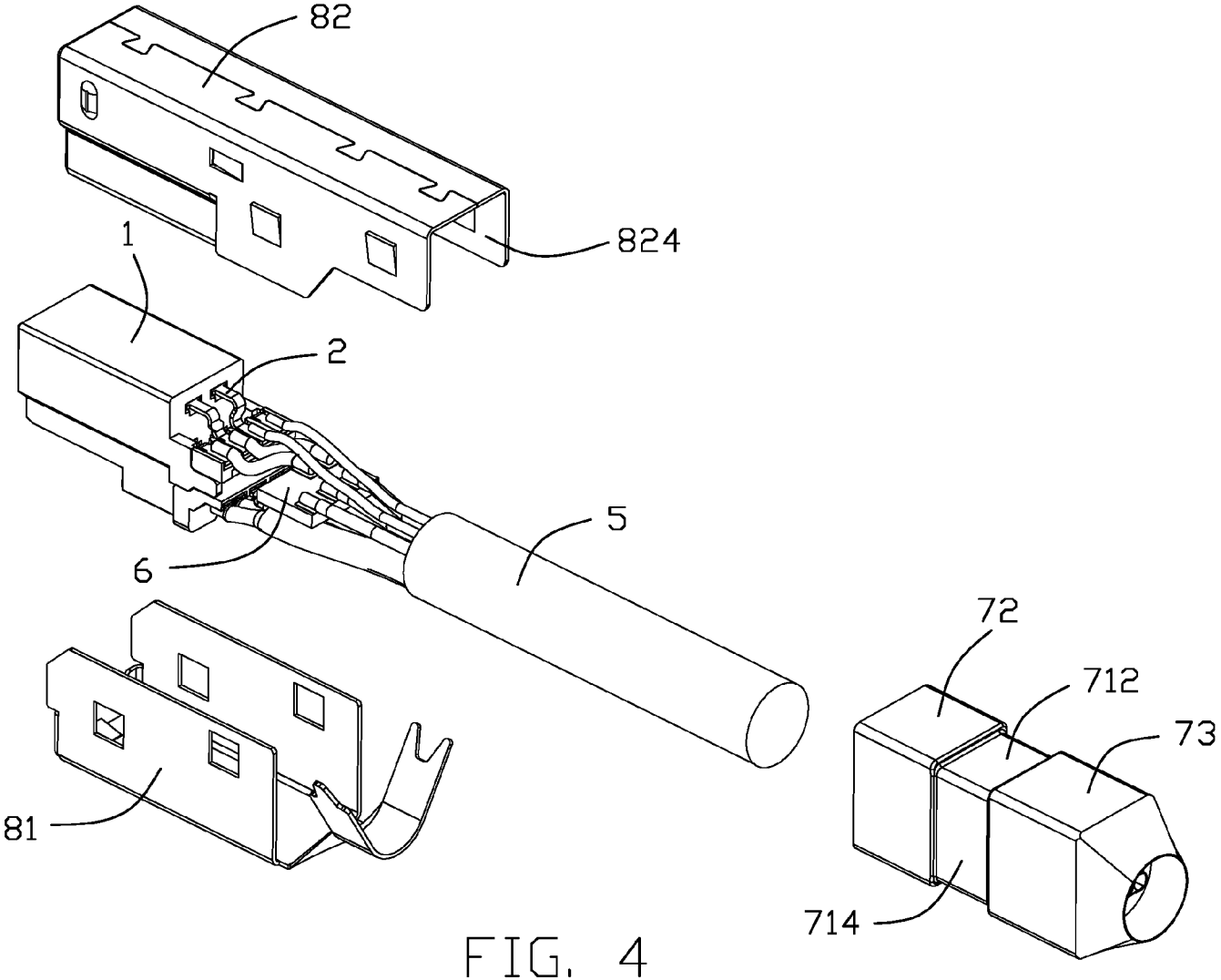
FIG. 4 is an partly exploded view similar to FIG. 3, but from a different perspective.
Figure 5:
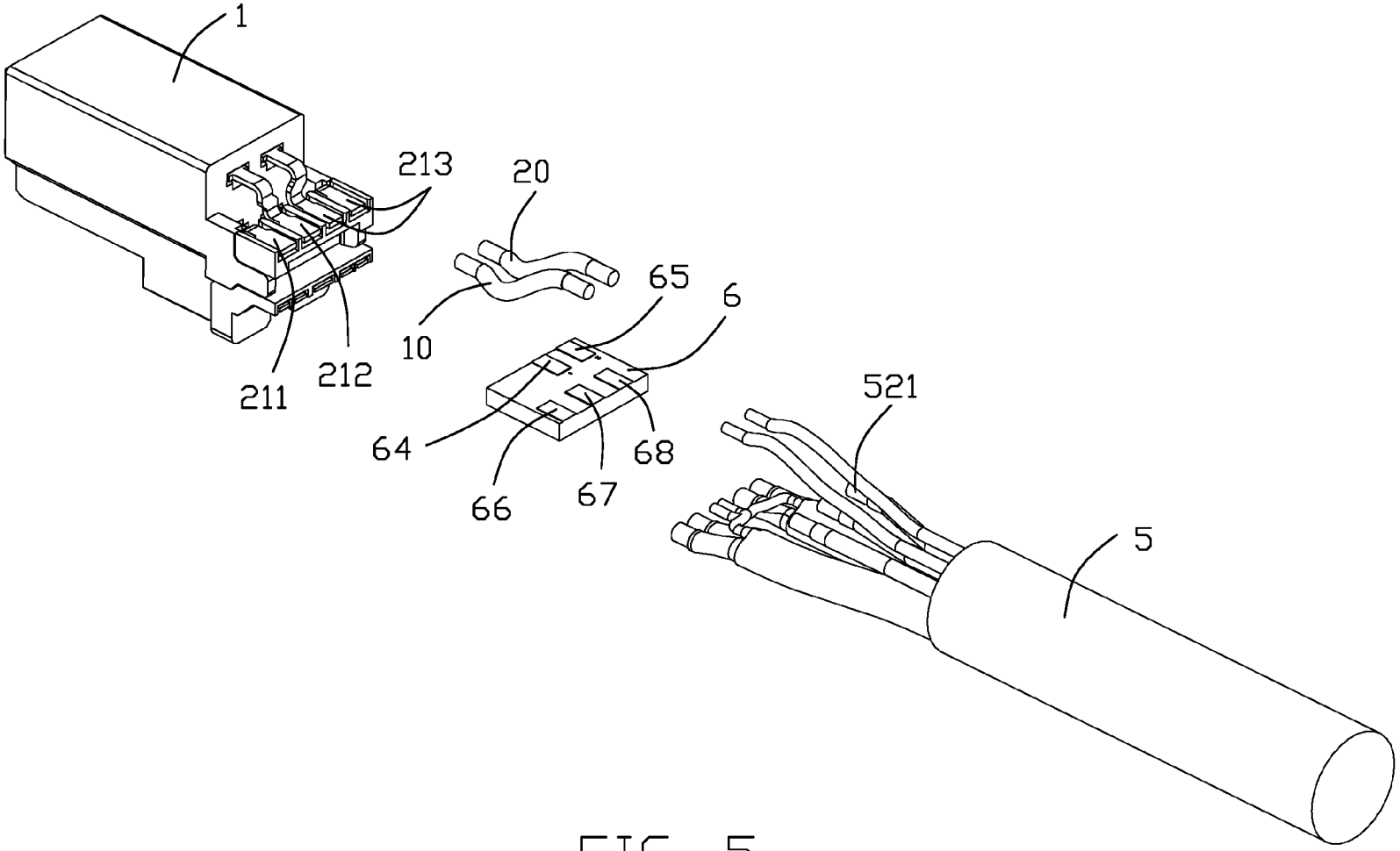
FIG. 5 is a partly exploded view of a part of the cable connector assembly shown in FIG. 1.
Figure 6:
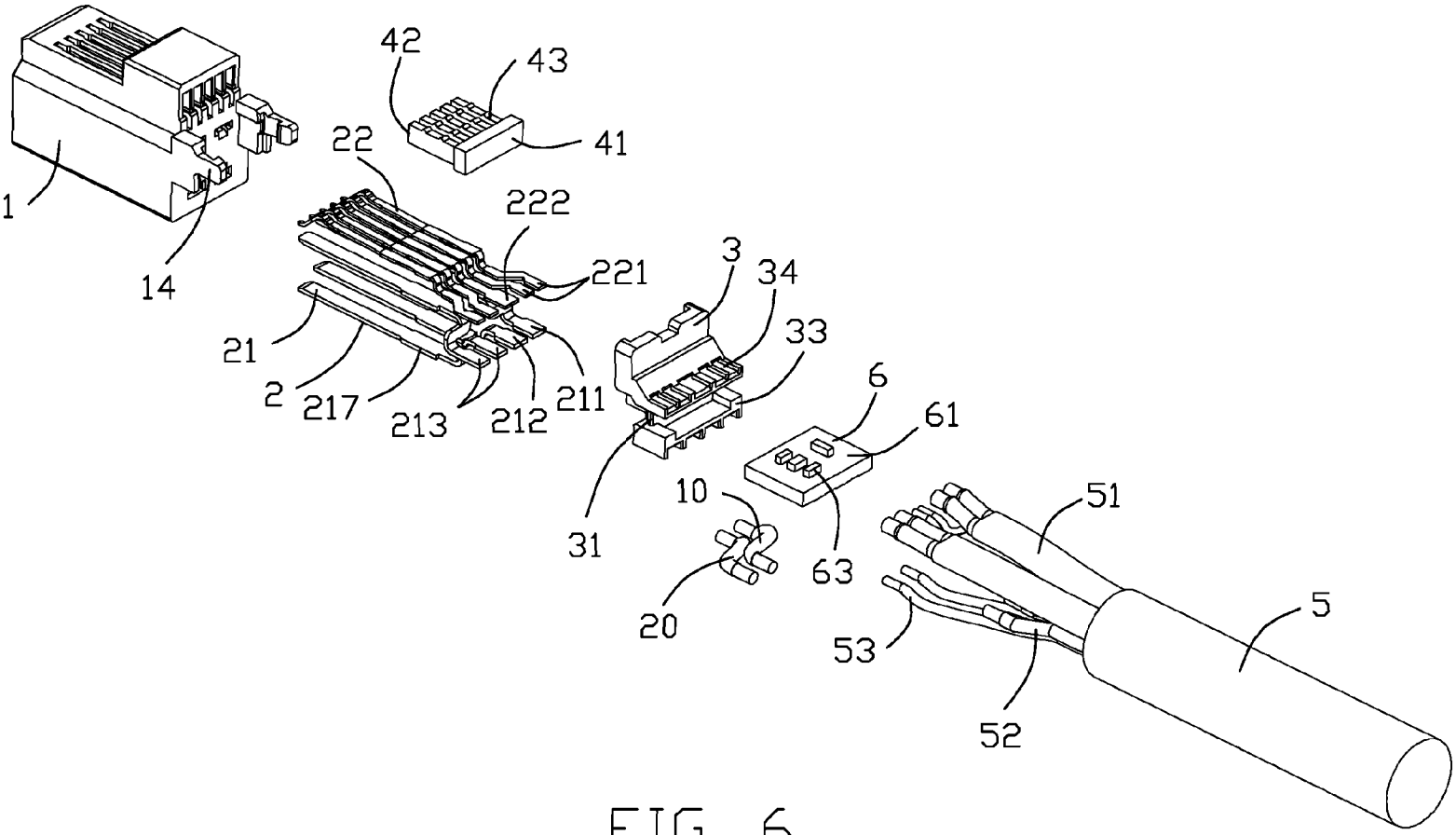
FIG. 6 is an exploded view of a part of the cable connector assembly shown in FIG. 1.
Figure 7:
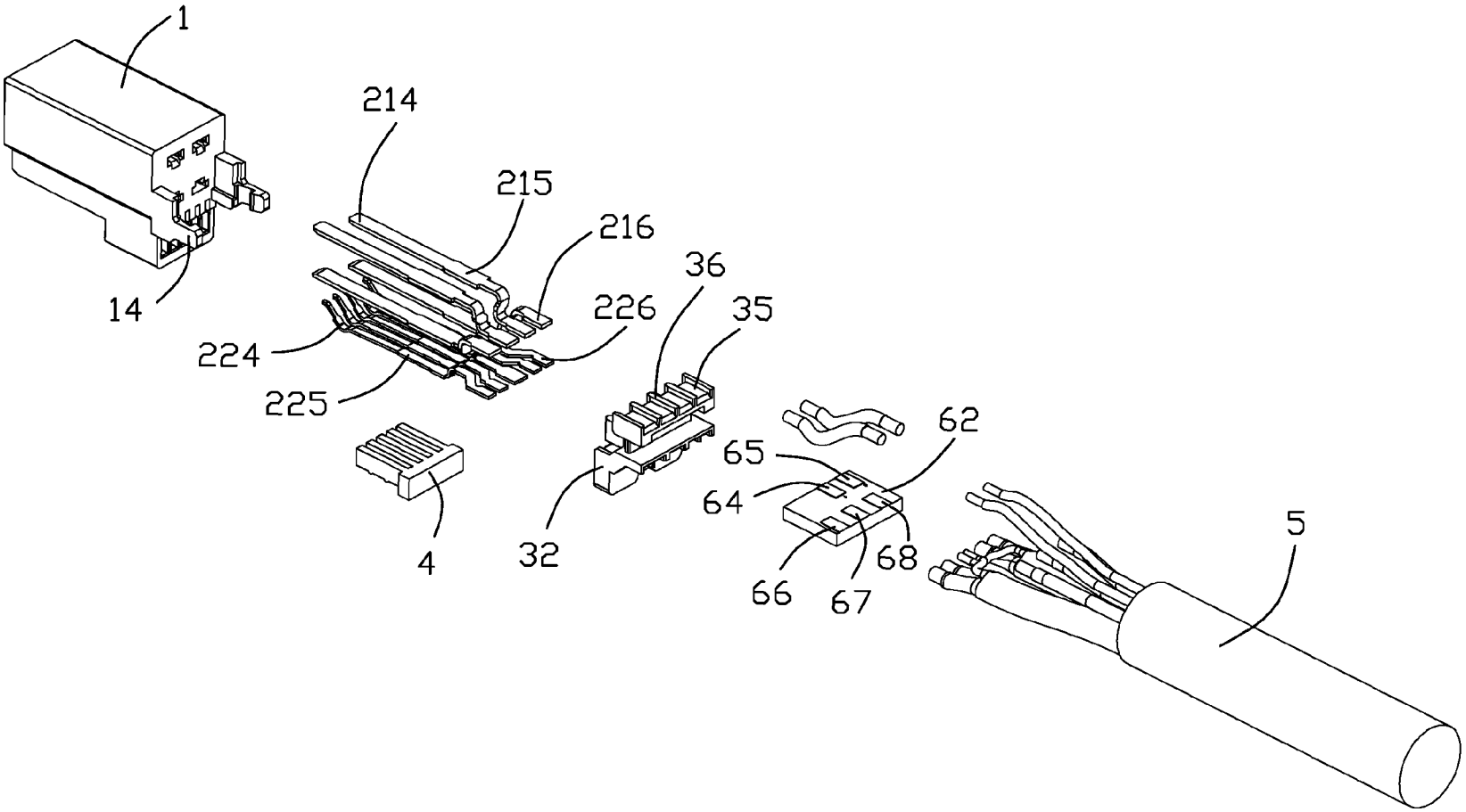
FIG. 7 is an exploded view similar to FIG. 6, but from a different perspective.

Referring to FIGS. 1-9, a cable connector assembly 100 according to a preferred embodiment of the present invention is used to electrically connect with a mating connector. The cable connector assembly 100 includes an insulative housing 1 defining a front mating port and a rear connecting port along a front-to-back direction, a plurality of contacts 2 retained in the insulative housing 1, a spacer 3 assembled on a rear end of the insulative housing, a stopping member 4 disposed on a front side of the spacer 3, a cable 5 electrically connected with the contacts 2, a printed circuit board (PCB) 6 electrically connected with the contacts 2, an insulative member 7 enclosing the PCB 6, a shielding case 8 enclosing the insulative housing 1 and a cover member 9 covering the shielding case 8. In the present embodiment, the cable connector assembly 100 is USB-B plug connector assembly, for electrically mating with a mating connector (not shown). The contacts 2 include a plurality of first contacts 21 for transmitting low-frequency signals, and a plurality of second contacts 22 for transmitting high-frequency signals.

The insulative housing 1 includes a first port 11 through a front surface and a rear surface thereof, and a second port 12 through the front surface and a top surface thereof. The second port 12 is disposed on a top side of the first port 11. The first port 11 defines a plurality of first receiving slots 111 therein for receiving the first contacts 21, which are arranged on the both opposite sidewalls of the first port 11 symmetrically. The second port 12 defines a plurality of second receiving slots 121 on a bottom surface thereof, for receiving the second contacts 22. Technically speaking, each of the first port and the second part essentially defines a front mating port and a rear connecting port. The insulative housing 1 further includes a pair of latch arm 14 backwardly extending from both sides thereof respectively.

The first contacts 21 transmits standard signal in accordance with USB 2.0 standard, including four contacts. The four first contacts 21 include a power contact 211, a grounding contact 212 and a pair of differential signal contacts 213. Each of the first contacts 21 defines a plate-shaped contacting portion/section 214, a fixing portion 215 rearwardly extending from the contacting portion 214 and a soldering portion or connecting section 216 disposed on a trailing end thereof. The contacting portions 214 of the first contacts 21 are received in the first port 11 and arranged in an upper and a lower row respectively. Each of the fixing portions 215 defines a pair of projecting barbed portion 217 on both sides thereof. The soldering portions 216 of the first contacts 21 are arranged in a row along a horizontal direction.

The second contacts 22 transmit high-frequency signal. The second contacts 22 includes two pairs of differential signal contacts 221 and a grounding contact 222 disposed between the two pairs of differential signal contacts 221, all of them are arranged in accordance with USB 3.0 standard. One pair of differential signal contacts 221 is for high-frequency signal output, and another pair of differential signal contacts 221 is for high-frequency signal input. The grounding contact 222 is disposed between the pairs of differential signal contacts 221, for reducing crosstalk in high-frequency signal transmission. Each of the second contacts 22 defines a resilient contacting portion/section 224, a soldering portion or connecting section 226 and a fixing portion 225 connecting between the contacting portion 224 and the soldering portion 226. The second contacts 22 are received in the second port 12. The soldering portions 226 of the second contacts 22 are arranged in a row above the soldering portions 216 of the first contacts 21 along the horizontal direction. The soldering portions 226 of the pairs of differential signal contacts 221 are outwardly deviated relative to the straight line which the corresponding contacting portion 224 extending along, for increasing the distance between adjacent soldering portions 226.

The stopping member 4 includes a rectangular body portion 41, a plurality of projecting portions 42 forwardly extending from the body portion 41 and a plurality of spurs portions 43 projecting from an upper surface of each projecting portion 42. In the present embodiment, the stopping member 4 and the spacer 3 is provided separately, but in other embodiment, the stopping member 4 and the spacer 3 can be provided integrally. The insulative housing 1 further defines a third port 13 for engaging with the stopping member 4. The third port 13 is defines behind the second port 12 and communicates with the second port 12. The projecting portions 42 of the stopping member 4 are inserted into the third port 13 along a rear-to-front direction, to fill the inters pace of the third port 13 after the second contacts 22 are inserted into the third port 13, for reducing the impedance of high frequency signal contacts. The projecting portions 42 of the stopping member 4 downwardly press the second contacts 22 tightly. The second contacts 22, the stopper member 4 and the insulative housing 1 have a certain holding force, which prevents the second contacts 22 from rearwardly backing out.

The spacer 3 define a pair of latch block 31 on both sides thereof, for latching with the corresponding latch arms 14 of the insulative housing 1. The spacer 3 includes a base portion 32, a first and a second holding block 33, 34 rearwardly extending from the base portion 32 and a plurality of notches 35 defined on the first and second holding block 33, 34. The first holding block 33 and the second holding block 34 are spaced along the vertical direction. The soldering portions 216, 226 are extended to expose to the rear end of the insulative housing 1 to be received in the corresponding notches 35. A plurality of stalls 36 are defined between each two adjacent notches 35.

The PCB 6 includes a top surface 61 and an opposite bottom surface 62. The PCB 6 defines a plurality of electronic components 63 on the top surface 61, and defines a plurality of conductive pads on the bottom surface 62. The conductive pads includes a first and a second pad 64, 65 defined on a front end of the PCB 6, and a third, a fourth, and a fifth pad 66, 67, 68 defined on a rear end of the PCB 6.

The cable connector assembly 100 further includes a first short wire 10 electrically connected between the power contact 211 and the corresponding first pad 64 of the PCB 6, and a second short wire 20 electrically connected between the grounding contact 212 and the corresponding second pad 62 of the PCB 6.

The cable 5 includes three rows of wires, a first row of wires 51, a second row of wires 52, and a third row of wires 53. The first row of wires 51 is electrically connected to the corresponding soldering portions 226 of the second contacts 22. The second row of wires 52 includes three wires, wherein a rightmost wire is a signal detection wire 521. All the wires of the second row of wires 52 are electrically connected to the third, the fourth, and the fifth pad 66, 67, 68, respectively. The third row of wires 53 includes two wires electrically connected to the corresponding soldering portions 216 of the pair of differential signal contacts 213.

The insulative member 7 is disposed in the shielding case 8. The insulative member 7 defines a recess portion 71 spaced relative to the shielding case 8, a first insulative portion 72 forwardly extending from the recess portion 71 and enclosing a rear end of the insulative housing 1, and a second insulative portion 73 rearwardly extending from the recess portion 71. The recess portion 71 defines an upper surface 711, an opposite lower surface 712, and a left and a right surface 713, 714 connecting between the upper and lower surface 711, 712. The width of the first insulative portion 72 is same to the width of the second insulative portion 73. The width of the recess portion 71 is smaller than the first insulative portion 72. The insulative member 7 integrally formed at the outer side of the PCB 6. The length of the PCB 6 is same to the recess portion 71 along the front-to-rear direction.

Figure 8:
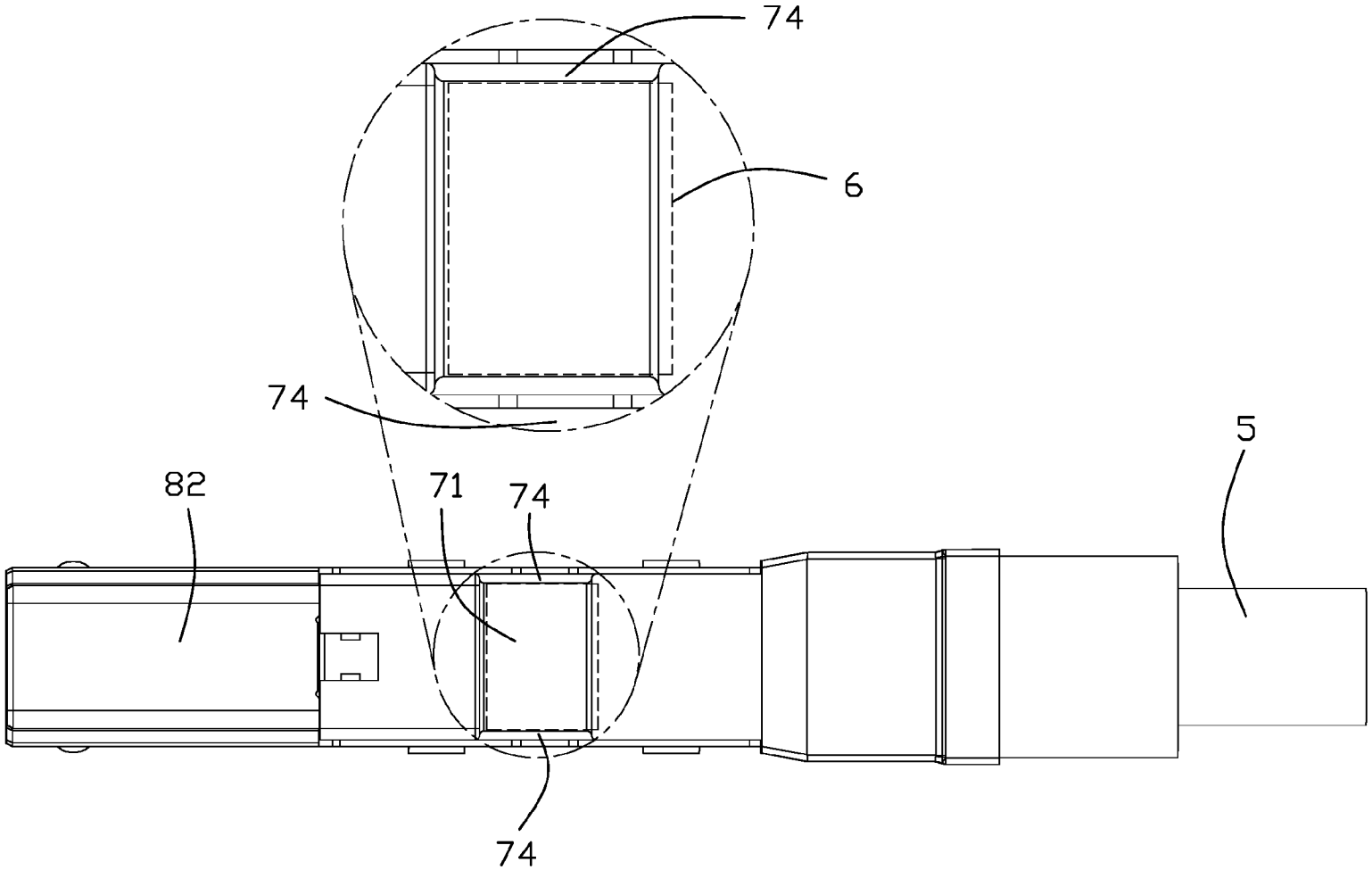
FIG. 8 is a plan view of the cable connector assembly shown in FIG. 1, omitting a cover member and a first shielding case thereof.
Figure 9:
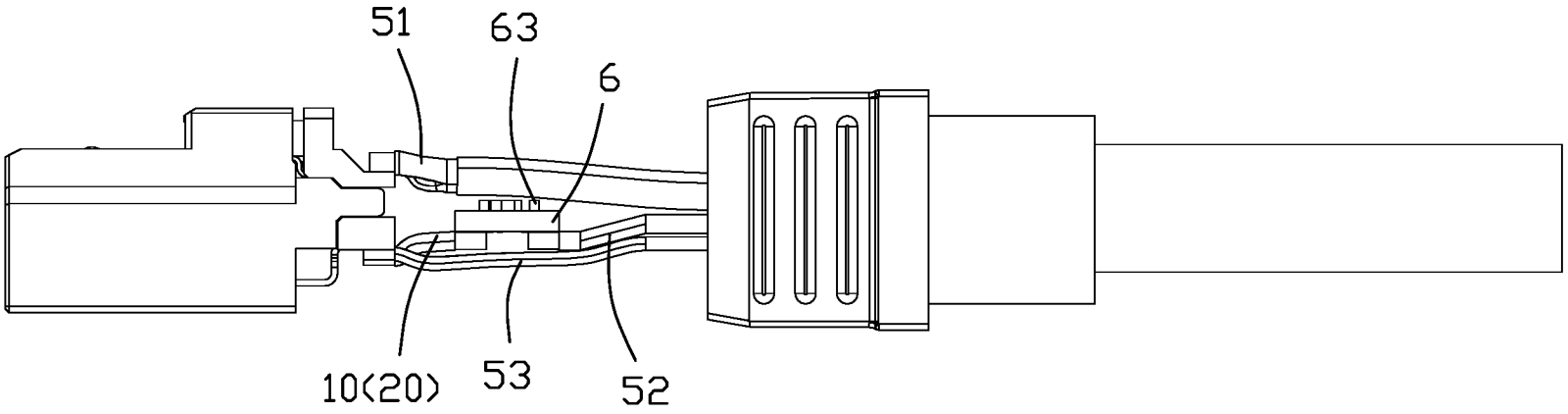
FIG. 9 is a side view of the cable connector assembly shown in FIG. 1, without the cover member, the shielding case and the insulative member thereof to show how the wires are connected to the corresponding contacts and the printed circuit board.

The shielding case 8 is made of metal material and comprises a first shielding portion 81 and a second shielding portion 82 engaged with the first shielding portion 81. The second shielding portion 82 includes a tubular portion 821 disposed on a font end, a drawer-like portion 822 rearwardly extending from the tubular portion 821. The cross section of the tubular portion 821 defines a top edge, a opposite bottom edge parallel to the top edge, and two side edges respectively connecting between the ends of the top edge and the bottom edge on same side. Each of two side edges defines a stepped portion at an intermediate position thereof. The length of the top edge is smaller than the length of the bottom edge. The first shielding portion 81 includes a tubular portion 822 engaged on the tubular portion 821 of the second shielding portion 82. The tubular portion 822 defines a bottom sidewall 823, a left and a right sidewall 824, 825 extending perpendicular to the bottom sidewall 823. An interval 74 is formed between the left surface 713 of the recess portion 71 and the left sidewall 824 of the tubular portion 822, and the width of the interval 74 is at least 0.3 mm. An interval 74 is formed between the right surface 714 of the recess portion 71 and the right sidewall 825 of the tubular portion 822, and the width of the interval 74 is at least 0.3 mm. When molding the insulating member 7, due to the molding pressure, the PCB 6 is prone to float or skew in the shielding case 8, which causes contacting of the PCB 6 and the shielding case 8, and leads to short circuit of entire electronic product or failure of the electronic components 63. The cable connector assembly 100 according to the present invention molds an insulative member 7 having a recess portion 71 restrictively enclosing the PCB6, in order to avoid the PCB 6 contacting with the shielding case 8, disregarding whether the PCB 6 is floating or not during molding the insulative member 7. On this way, the cable connector assembly avoids the risk of shorting, greatly improves the qualified. FIG. 8 also shows in this embodiment wherein the printed circuit board 6 is shown by the dashed lines, different from other type connectors in which the internal printed circuit board may be essentially held by the contact tails or the housing, the printed circuit board 6 in this embodiment is only held by the relatively flexible wires 10, 20 and 53. This is the reason why the possible floatation/deviation occurs during the overmolding process, and thus is also the reason why it is required to form the recesses 74 of the insulative member 7 around the two lateral sides of the printed circuit board 6, thus assuring no touching with the second shielding portion 82 even if the lateral side is very close to or even exposed upon the recess 74. In other words, such recess 74 results in an offset arrangement which assures the insulative member 7 not only is snugly received within the metallic shielding case 8 but also avoid risks of shorting between the printed circuit board 6. As shown in FIG. 9, the rear connecting sections of the first contacts and those of the second contacts are arranged in two row. Therefore, on one hand, the wires 53 and the front ends of the short wires 10, 20 are connected to the rear connecting sections of the corresponding first contacts, and the wires 51 are connected to the rear connecting sections of the second contacts; on the other hand, the wires 52 are connected to a rear region of the printed circuit board 6 while the rear ends of the wires 10/20 are connected to the front region of the printed circuit board 6 wherein the printed circuit board is located between the wires 53 and the wires 51 in the vertical direction.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising: an insulative housing; a plurality of contacts retained in the insulative housing; a printed circuit board electrically connected with at least some of the plurality of contacts; a cable electrically connected with the contacts and the printed circuit board; an insulative member enclosing the printed circuit board; and a shielding case enclosing the insulative housing and the insulative member; wherein the insulative member includes a recess portion spaced from the shielding case;
wherein the printed circuit board is disposed inwardly of the recess portion.

2. The cable connector assembly according to claim 1, wherein the insulative member includes a first insulative portion forwardly extending from the recess portion for enclosing a rear end of the insulative housing, and a second insulative portion rearwardly extending from the recess portion and having a same width to the first insulative portion.

3. The cable connector assembly according to claim 1, wherein the printed circuit board has same length to the recess portion along a front-to-rear direction.

4. The cable connector assembly according to claim 1, wherein the insulating member is molded integrally on the outer side of the printed circuit board.

5. The cable connector assembly according to claim 1, wherein an interval is formed between the recess portion and the shielding case, the interval having a width of at least 0.3 mm.

6. The cable connector assembly according to claim 1, wherein:

the plurality of contacts include a plurality of first contacts for transmitting low-frequency signal and a plurality of second contacts for transmitting high-frequency signal;

each of the first contacts and the second contacts includes a contacting portion and a soldering portion; and the insulative housing includes a first port through a front surface and a rear surface thereof for receiving the first contacts and a second port through the front surface and a top surface thereof for receiving the second contacts.

7. The cable connector assembly according to claim 6, further comprising a first short wire and a second short wire, and wherein the first contacts includes a power contact, a grounding contact, and a pair of differential signal contacts, the first short wire connecting the power contact to the printed circuit board and the second short wire connecting the grounding contact to the printed circuit board.

8. The cable connector assembly according to claim 6, wherein the cable includes a first row of wires, a second row of wires, and a third row of wires, the first row of wires electrically connected with a pair of differential signal contacts, the second row of wires electrically connected with the printed circuit board, the third row of wires electrically connected with the second contacts.

9. The cable connector assembly according to claim 8, wherein the second row of wires include a signal detection wire.

10. A cable connector assembly comprising:

an insulative housing defining a front mating port and a rear connecting port along a front-to-back direction;

a plurality of contacts disposed in the housing, each of said contacts having a front contacting section exposed in the front mating port, and a rear connecting section exposed in the rear connecting port, the rear connecting sections being arranged in opposite first and second rows in a vertical direction perpendicular to said front-to-back direction;

a printed circuit board located behind the housing in the front-to-back direction;

a plurality of short wires spanning in a transverse direction perpendicular to both said front-to-back direction and said vertical direction;

a cable including a plurality of first wires, second wires and third wires spanning in said transverse direction, front ends of the short wires and front ends of the third wires being connected to the corresponding rear connecting sections in the first row, front ends of the second wires being connected to the corresponding rear connecting sections in the second row, and front ends of the second wires and rear ends of the short wires being connected to the printed circuit board; and the printed circuit board being located between the first wires and the third wires in the vertical direction, and being held by said the short wires and the second wires without engagement with the housing or the contacts during a molding process to form an insulative member enclosing said printed circuit board; wherein said insulative member forms a pair of lateral recesses corresponding to the printed circuit board in the transverse direction.

11. The cable connector assembly as claimed in 10, wherein said second wires are connected to a rear region of the printed circuit board while the rear ends of the short wires are connected to a front region of the printed circuit board.

12. The cable connector assembly as claimed in claim 10, wherein a metallic case encloses the insulative member and is spaced from the printed circuit board by said recesses in the transverse direction.

13. The cable connector assembly as claimed in claim 10, further including a spacer which the rear connecting sections are seated on and which is located between the housing and the printed circuit board in the front-to-back direction.

14. The cable connector assembly as claimed in claim 10, wherein the first wires are diametrically larger than the second wires, and the second wires are diametrically larger than the third wires.

15. The cable connector assembly as claimed in claim 10, wherein the printed circuit board defines opposite first and second surfaces, the first surface faces toward the first wires and the second surfaces faces the third wires, and a plurality of electronic components are located upon the first surface.

16. The cable connector assembly as claimed in claim 10, wherein a dimension of the printed circuit board along the front-to-back direction is similar to that of the recess along the front-to-back direction.

17. A cable connector assembly comprising:

an insulative housing defining a front mating port and a rear connecting port along a front-to-back direction;

a plurality of contacts disposed in the housing, each of said contacts having a front contacting section exposed in the front mating port, and a rear connecting section exposed in the rear connecting port, the rear connecting sections being arranged in opposite first and second rows in a vertical direction perpendicular to said front-to-back direction;

a printed circuit board located behind the housing in the front-to-back direction;

a plurality of short wires spanning in a transverse direction perpendicular to both said front-to-back direction and said vertical direction;

a cable including a plurality of first wires, second wires and third wires spanning in said transverse direction, front ends of the short wires and front ends of the third wires being connected to the corresponding rear connecting sections in the first row, front ends of the second wires being connected to the corresponding rear connecting sections in the second row, and front ends of the second wires being connected to a rear region of the printed circuit board while rear ends of the short wires being connected to a front region of the printed circuit board;

the printed circuit board being located between the first wires and the third wires in the vertical direction, and being held by said the short wires and the second wires without engagement with the housing or the contacts during a molding process to form an insulative member enclosing said printed circuit board; and a metallic shielding case snugly enclosing and securing the insulative member;

wherein a pair of lateral sides of the printed circuit board are spaced from the metallic shielding case in the transverse direction via a pair of recesses, respectively.

18. The cable connector assembly as claimed in claim 17, wherein the first wires are diametrically larger than the second wires, and the second wires are diametrically larger than the third wires.

19. The cable connector assembly as claimed in claim 17, wherein each of said recesses are formed in the insulative member along both the front-to-back direction and said transverse direction.

* * * * *